United States Patent [19]

Vignolles

[11] 3,987,825

[45] Oct. 26, 1976

[54] TREE BARK REMOVING APPARATUS

[76] Inventor: Jean-Claude Vignolles, 40610 Arengosse, France

[22] Filed: Oct. 9, 1975

[21] Appl. No.: 621,158

[30] Foreign Application Priority Data

Oct. 15, 1974 France ..... 74.35236

[52] U.S. Cl. ..... 144/208 F; 144/208 R; 144/246 R; 144/246 C; 144/311

[51] Int. Cl.[2] ..... B27L 1/04

[58] Field of Search ..... 144/208 R, 208 F, 208 G, 144/208 J, 311, 242 R, 242 C, 246 R, 246 A, 246 B, 246 C, 246 D, 246 F, 246 G

[56] References Cited

UNITED STATES PATENTS

| | | | |
|---|---|---|---|
| 2,505,168 | 4/1950 | Augustin | 144/208 F X |
| 2,698,036 | 12/1954 | Hilborn | 144/208 G |
| 2,765,011 | 10/1956 | Jackson | 144/208 F |
| 2,771,922 | 10/1956 | Gyllenberg | 144/208 F |
| 3,008,503 | 11/1961 | Hilborn | 144/246 C X |
| 3,529,639 | 9/1970 | Herolf | 144/208 R X |

FOREIGN PATENTS OR APPLICATIONS

| | | | |
|---|---|---|---|
| 13,472 | 11/1904 | Norway | 144/208 F |

*Primary Examiner*—Othell M. Simpson
*Assistant Examiner*—W. D. Bray
*Attorney, Agent, or Firm*—W. G. Fasse; W. W. Roberts

[57] ABSTRACT

The present tree bark removing apparatus is suitable for mounting on a carriage for mobile use and also for stationary installation, for example, in a saw mill. A frame structure supports two rows of driven wheels which form a tree trunk passage. The wheels are, for example, driven by a frictional contact with a drive roller extending along and in contact with the two rows of wheels. A tool supporting bridge carries a tiltable platform, which in turn has secured thereto a cantilever arm, the free end of which supports the tool head. The platform is tiltable by power means so that the free end of the cantilever and thus the tool may be brought into contact with a tree trunk, which is moved past the tool by the rotating wheels. For this movement the wheels extend at an angle relative to the longitudinal axis of the apparatus to propell the tree trunk past the tool whereby the tree trunk rotates simultaneously with the longitudinal movement.

19 Claims, 6 Drawing Figures

TREE BARK REMOVING APPARATUS

BACKGROUND OF THE INVENTION

The present invention relates to a tree bark removing apparatus, more specifically, to such an apparatus which may be pulled by a tractor, or which may be installed permanently.

Prior art machines for the removal of the bark from trees either of the stationary or mobile type have several drawbacks. Especially, the so called mobile type machines are very heavy, which makes it difficult to bring these machines into the felling area, particularly where a rugged ground surface must be traversed. Further, prior art machines still require that they be stationary when in operation. As a result, the macines tend to get bogged down, especially on soft ground and their removal tends to be tedious, and time consuming.

The bark removal by manual labor is also disadvantageous, because it is time consuming and expensive.

Yet another problem arising from prior art bark removal methods is seen in that the removed bark accumulates in the processing area and it becomes necessary to use a separate spreader by means of which the removed bark is distributed over the forest floor.

OBJECTS OF THE INVENTION

In view of the above, it is the aim of the present invention to achieve the following objects singly or in combination:

- to provide a bark removal apparatus of relatively light weight construction, which may be easily operated as it moves through the felling area;
- to construct a bark removal apparatus in such a manner that it may remain mobile even if it is in operation, and even on very rugged terrain;
- to provide a machine which will spread the bark on the floor, as it removes the bark and as it moves through the felling area, for example, pulled by a tractor, whereby all the power required for the operation of the bark removal apparatus may be derived from the tractor output shaft;
- to construct a bark removal apparatus in such a manner that it may be easily operated substantially by one operator alone, whereby all functions are carried out automatically;
- to equip a machine of this type with control means for adjusting the speed at which a tree may travel past the bark removal tool;
- to control the tree trunk in such manner that it performs simultaneously a rotational movement and a longitudinal movement;
- to locate and control the tool for the bark removal, as well as the tool drive means for the bark removal in such a position that these elements will not interfere with the feed advance of a tree trunk;
- to provide means for controlling the pressure which presses the tool against the surface of the tree in such a manner that the yieldingly supported tool holding means may respond to irregularities on the surface of a tree trunk, such as knots, branch ends or the like; and
- to greatly reduce the costs for the removal of bark from trees, as compared to the respective costs in connection with prior art methods and devices.

SUMMARY OF THE INVENTION

According to the invention there is provided an aparatus for the removal of bark from trees, wherein a frame structure supports two rows of transport wheels which form a trunk passage extending longitudinally of the frame structure. Drive means such as a friction roller common for all wheels in both rows is also rotatably supported in the frame structure. Each wheel is individually supported on the frame structure for vertical yielding and for horizontal adjustment. Preferably all the support carriers for the wheels are connected to a common adjustment mechanism, whereby all the wheels extend in parallel to each other and at the same tilting angle relative to the longitudinal axis of the apparatus, and thus to the feed advance direction of the tree trunk. A tool supporting bridge is secured to the frame structure and carries the tool means above the trunk passage. The tool means include a carrier supporting a cantilever arm which in turn supports the tool means proper, such as a substantially star shaped saw blade and a rotary cutter. The cantilever with its carrier platform is tiltable up and down whereby the pressure exerted on the tool may be varied in response to feed back means which provide a control signal in response to the tool encountering an irregularity on the surface of the tree trunk. Further, the position of the cantilever is adjustable to accommodate tree trunks of different diameters and the cantilever may be tiltable relative to its carrier or platform so that the tool supporting rotor shafts and the tool carried thereby may easily follow the contour on the surface of a tree trunk.

BRIEF FIGURE DESCRIPTION

In order that the invention may be clearly understood, it will now be described, by way of example, with reference to the accompanying drawings, wherein.

DETAILED DESCRIPTION OF EXAMPLE EMBODIMENTS

Figure 1:
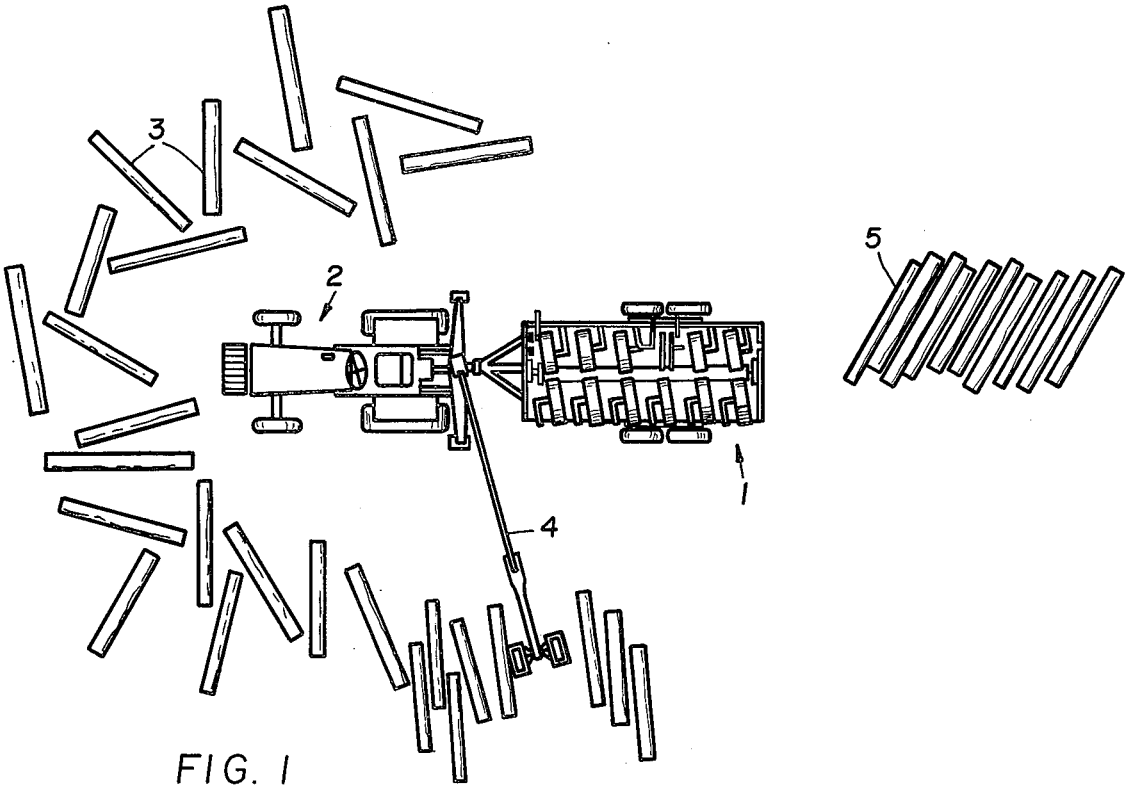
FIG. 1 is a bird's eye view of the present apparatus pulled by a tractor.

The bird's eye view of FIG. 1 shows the present apparatus 1 in position ready for operation. A tractor 2 pulls the bark removal apparatus 1 through the forest. The felled tree trunks 3 are picked up by a crane 4 which places the tree trunks into the apparatus 1. The peeled tree trunks 5 are automatically arranged in a more or less orderly row behind the apparatus 1.

Figure 2:
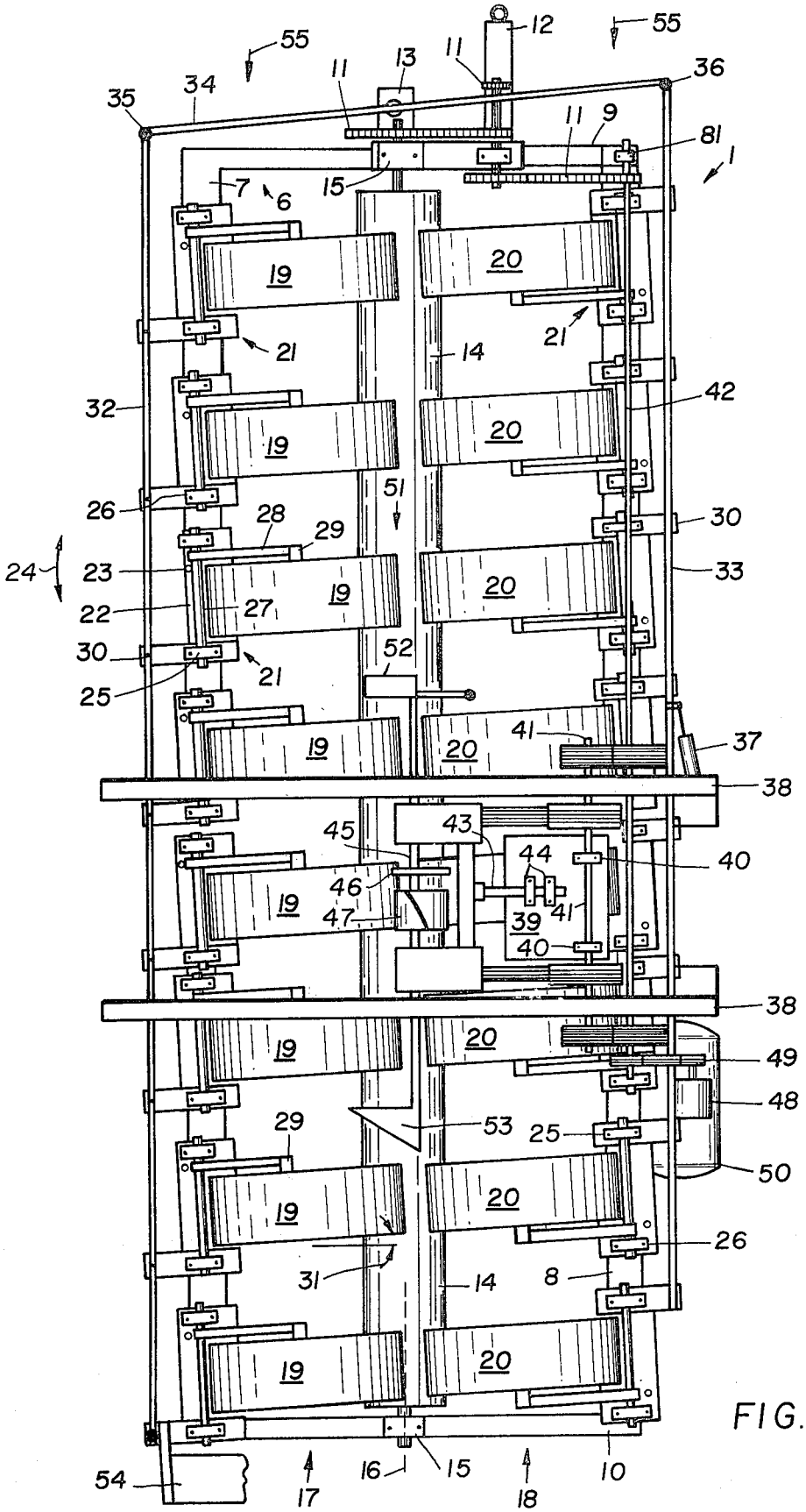
FIG. 2 is a somewhat simplified top plan view of the present apparatus.

FIG. 2 illustrates a top plan view of the present apparatus 1. In the following text the present apparatus will simply be called the "peeler" 1 for simplicity's sake. The peeler 1 comprises according to the invention a frame structure 6 with longitudinal side frame members 7 and 8 rigidly interconnected by cross frame members 9 and 10. Drive means, such as a plurality of gear wheels 11, are rotatably supported on the frame structure 6. Power input means 12 are operatively connected to the gear wheels 11. The power input coupling 12 may be connected by conventional means to the power output shaft of the tractor 2. The peeler 1 is hitched to the tractor 2 by a conventional hitch 13.

A roller 14 is rotatably supported by bearings 15 at each of its ends. The drive roller 14 is driven, for example through the gear wheels 11, from the power input coupling 12. The frame structure 6 has a longitudinal axis 16 which extends, for example, though not necessarily, longitudinally through the drive roller 14. A first row 17 of drive wheels is rotatably secured to the side frame member 7. A second row 18 of drive wheels is rotatably secured to the side frame member 8.

The first row 17 comprises a number of wheels 19. The second row 18 comprises a plurality of wheels 20. Each wheel 19, 20 is individually supported on its respective side frame member 7, 8 by wheel support means 21. Each wheel support means or mechanism 21 is of the same construction as any other of the wheel support means. Therefore only one such support means will be described in more detail. Each wheel support mechanism 21 comprises a support plate 22 which is secured to a vertical journal shaft 23, the lower end of which is attached to the side frame member 7 or 8. Due to this journal shaft 23 the support plate 22 is adjustable in a horizontal plane relative to the side frame member 7 as indicated by the arrow 24. Two bearings 25 and 26 are attached to the support plate 22 and carry a shaft 27. A tilting arm 28 is secured with one of its ends to the shaft 27 and carries at its opposite end an axle 29 for its respective wheel 19, 20. The wheels 19 and 20 are freely rotatable about their respective axle 29 when the drive roller 14 rotates in frictional contact with the wheels.

Each wheel support mechanism 21 further includes a lever 30 by means of which the support plate 22 may be adjusted in a horizontal plane about the journal shaft or bearing 23. Thus, it is possible to adjust the wheels into an angular position relative to the longitudinal axis 16 of the drive roller 14. The angle 31 which is included between the normal to the axis 16 and a plane defined by the respective wheel and extending normal to the respective wheel axle 29 may range from 0° to about 14°. When this angle 31 is 0° the wheels will extend at a right angle relative to the drive shaft. In that instance, it may be necessary to apply a longitudinally effective force to the tree trunk being peeled in addition to the rotation imparted to the tree trunk by the wheels 19, 20.

By adjusting the angle 31 and thus the position of the wheels relative to the longitudinal axis 16 it is possible to control the feed advance speed of a tree trunk. To this end it is desirable to adjust all the wheels of one row in unison. Thus, the levers 30 are secured to an operating mechanism including longitudinal actuating rods 32 and 33 interconnected by a cross rod 34. The rod 32 is connected to the rod 34 by a pivot joint 35 whereas the rod 33 and the rod 34 are interconnected by a pivot joint 36. All the levers 30 are pivoted to their respective rod 32 or 33.

Further, in order to achieve a uniform adjustment of all the wheels piston cylinder means 37 are arranged between any one of the rods and the frame structure 6. By controlling or adjusting the piston cylinder means 37 it is possible to place all the wheels into the desired angular position to control the speed of a tree trunk 3 as it moves through the peeler 1. This will be described in more detail below with reference to the operation of the machine.

Tool support means, including a bridge structure 38, are carried by the frame 6. The tool support means include a carrier or platform 39 journaled by bearings 40 to a drive shaft 41 which in turn is journaled by bearings, not shown, to the bridge structure 38. The drive shaft 41 is connected through power transmission means to a main drive shaft 42 which in turn is linked through gear means 11 or the like to the power input coupling 12. The details of the tool control will be described below with reference to FIG. 5.

A cantilever arm 43 is secured to the platform 39 by journal bearings 44. The cantilever arm 43 carries at its free end a tool rotor shaft 45 having secured thereto a saw blade 46 and a rotary peeling knife or cutter 47. These elements will also be described in more detail with reference to FIG. 5 below.

A source of pressure 48, such as a compressor, is also driven by the main drive shaft 42 through respective pulleys 49. The compressor 48 is connected to a pressure tank 50. The pneumatic system including the compressor and the tank are employed in connection with the various control functions which will also be described below.

A trip dog switch 52 is arranged in the tree trunk passage between the wheels 19, 20. As the tree trunk advances in the direction of the arrow 51 it will first contact the trip dog switch 52 to energize the tool position control means. As the rear end of the tree trunk passes the second trip dog switch 53, the tool positioning control means will be switched off.

A trunk deflection plate 54 is secured to the rear end of the peeler 1 in such a manner that the peeled trunks 5 will be guided off the apparatus to form the row of peeled tree trunks 5 as shown in FIG. 1.

Figure 3:
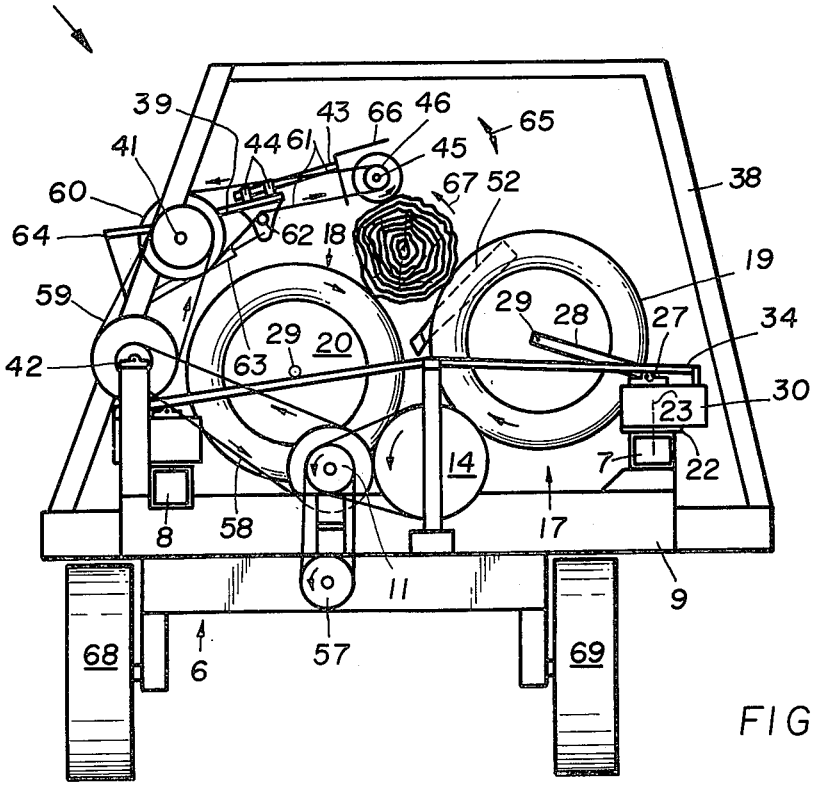
FIG. 3 is a front view of the apparatus according to FIG. 2.

FIG. 3 is a view of the front end of the peeler 1 in the direction of the arrows 55 in FIG. 2. The same reference numerals will apply to the respective elements in FIG. 3. Thus, a tree trunk 3 moves through the passage 56 between the rows 17 and 18 of respective wheels 19 and 20, since the main drive roller 14 and thus the wheels 19 and 20 keep rotating. As the trunk 3 reaches the trip dog 52 the latter will be actuated for bringing the tool means into an operative trunk engaging position.

The power input 12 drives a gear or pulley 57 which in turn drives a pulley or gear 11 through a respective belt or chain and the power is continuously transmitted to the drive roller 14. The same power source also drives the main drive shaft 42, for example, through transmission means 58. The main drive shaft 42 is operatively connected through transmission means 59 to the journal shaft 41 which is supported in bearings, not shown, but secured to the bridge structure 38. Transmission means, such as a pulley 60 and belt means 61, transmit the power to the tool supporting rotor shaft 45. A guide pulley 62 for the belt means 61 keeps the belt means 61 out of contact with the wheels 19 therebelow. Thus the tools will normally continuously rotate even if they are in the non-engaging upper position.

The platform or tool carrier 39 is tiltable about the axis 41 of the respective shaft by power means, such as a piston cylinder arrangement 63, secured at one end thereof to the frame structure and at the other end thereof to an extension of the tool carrier 39. This piston cylinder arrangement is operated by the pressure control system including the compressor 48 to force the tool 46, 47 against the tree trunk 3 when switch 52 is actuated.

Pressure responsive sensing means 60 in the form of an extension arm secured to the platform 39 are employed to control the piston cylinder 63 in a feedback fashion and in response to the movement of the cantilever arm 43 up and down as indicated by the arrow 65. This feedback control circuit including the sensing means 64 will be described in more detail below with reference to FIGS. 5 and 6.

A hood 66, preferably covers the tools 46 and 47, so that the peeled off or rather shredded off bark will be deflected downwardly.

The direction of the rotation of the several power transmission means is indicated by the arrows. Thus, the tool means rotate for example counterclockwise and so does the tree trunk 3, as indicated by the arrow 67, whereby the tool means and the tree trunk 3 rotate in opposite directions at the point of contact which greatly facilitates the rapid and efficient bark shredding and removal.

It will be noted that the two rows of wheels 17 and 18 are supported in such a manner that the respective rotational axis 29 extends at different elevational levels. Thus, the row 17 is slightly higher located than the row 18. This feature of the invention has the advantage that the cradle effect is improved because the force components resulting from the location of the wheels now include a laterally directed component which tends to keep the tree trunk 3 in the passage 56, against any lateral force component which may result from the rotation of the tool engaging the tree trunk. As mentioned, the main drive roller 14 rotates both rows of wheels by friction but pulley drives or the like could be employed if desired.

The frame structure 6 is, for example, supported on wheels 68, 69 which may be regular truck wheels to make the entire peeler mobile to be pulled by a tractor, as illustrated in FIG. 1. However, the present invention is equally suitable for a stationary arrangement, for example in a saw mill. In any event, the wheels 19 and 20 which form the cradle and passage 56 may also be regular automobile or truck wheels with pneumatic tires. Due to the rotation of these wheels or tires the tree trunk will also be rotated and due to the above mentioned angular position of the tires the tree trunk will be propelled in a longitudinal direction as indicated by the arrow 51 in FIG. 2.

Figure 4:
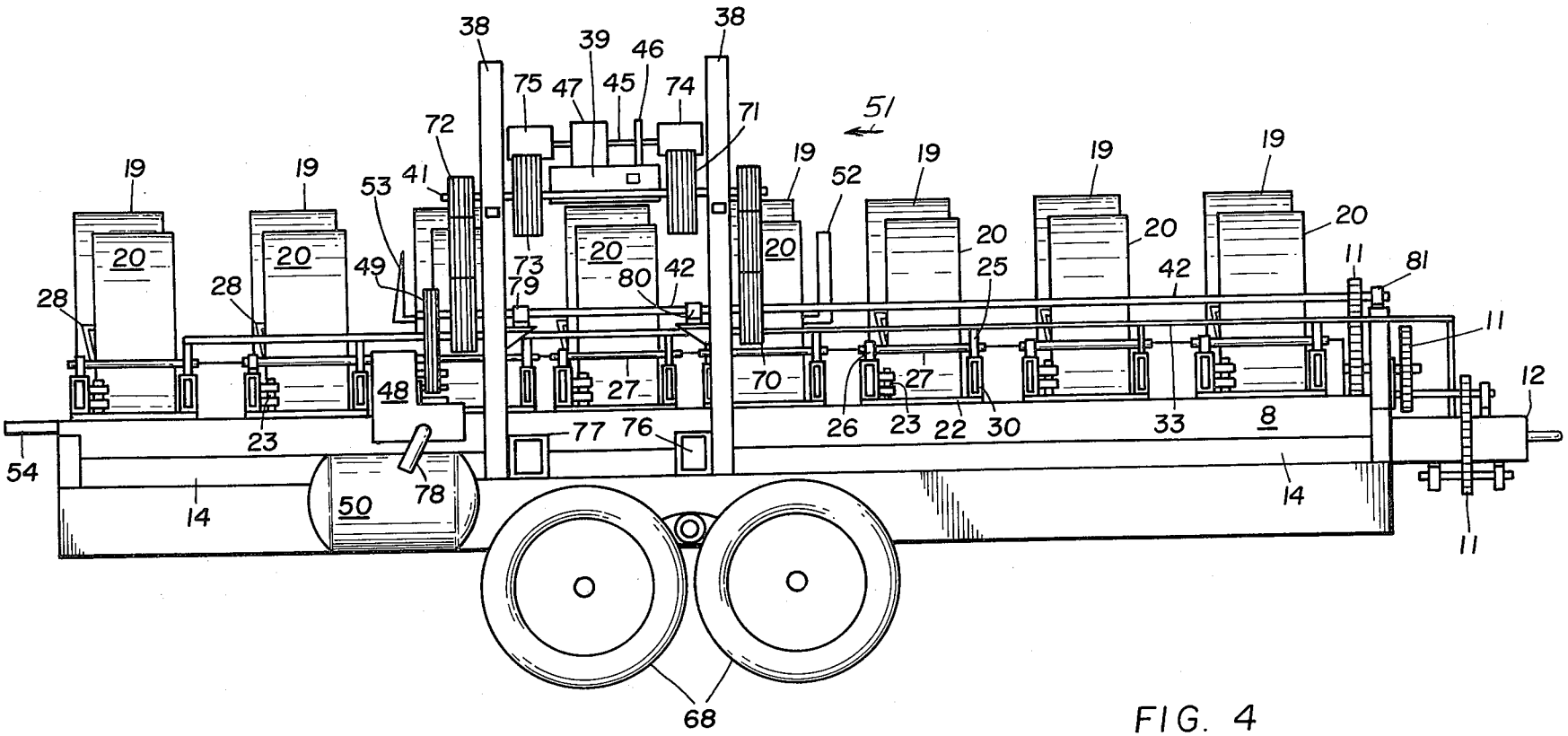
FIG. 4 is an elevational side view of the apparatus according to FIG. 2.

FIG. 4 illustrates a side view of the peeler according to the invention whereby certain elements have been omitted to simplify the illustration. For example, the cantilever arm 43 connecting the carrier platform 39 and the tool rotor shaft 45 has been omitted in FIG. 4. Further, as in FIG. 2, there are shown two sets of pulleys and drive belts 70, 71 and 72, 73 which interconnect the main drive shaft 42 and the tool rotor shaft 45 through the drive shaft 41. These connections could also be realized through sprockets and respective chain drives. However, it is not necessary that two sets of power transmission means are interposed between the main drive shaft 42 and the tool rotor 45, one set would also be satisfactory. Two sets of power transmission means symmetrically arranged relative to the bridge 38, however, assure a more symmetric power transmission and distribution.

Guard covers 74 and 75 are arranged to cover up the pulleys on the tool rotor shaft 45. The hood 66 for the tool means proper is not shown in FIG. 4.

Incidentally, the tubular frame structure may become part of the pneumatic control system. For example, the hollow frame member 76, 77 could be closed pressure tight and connected to the compressor 48 which is shown to be connected to the pressure tank 50 by hose means 78.

Furthermore, the support plates 22 for the wheel supporting mechanisms are movable in the horizontal plane extending perpendicularly to the plane of the drawing in FIG. 4. To this end, the whole supporting mechanism is tiltable about its respective vertical axis 23.

The main drive shaft 42 is supported by bearings 79 and 80 in the bridge structure 38 and by further bearing 81 on the frame structure 6.

Figure 5:
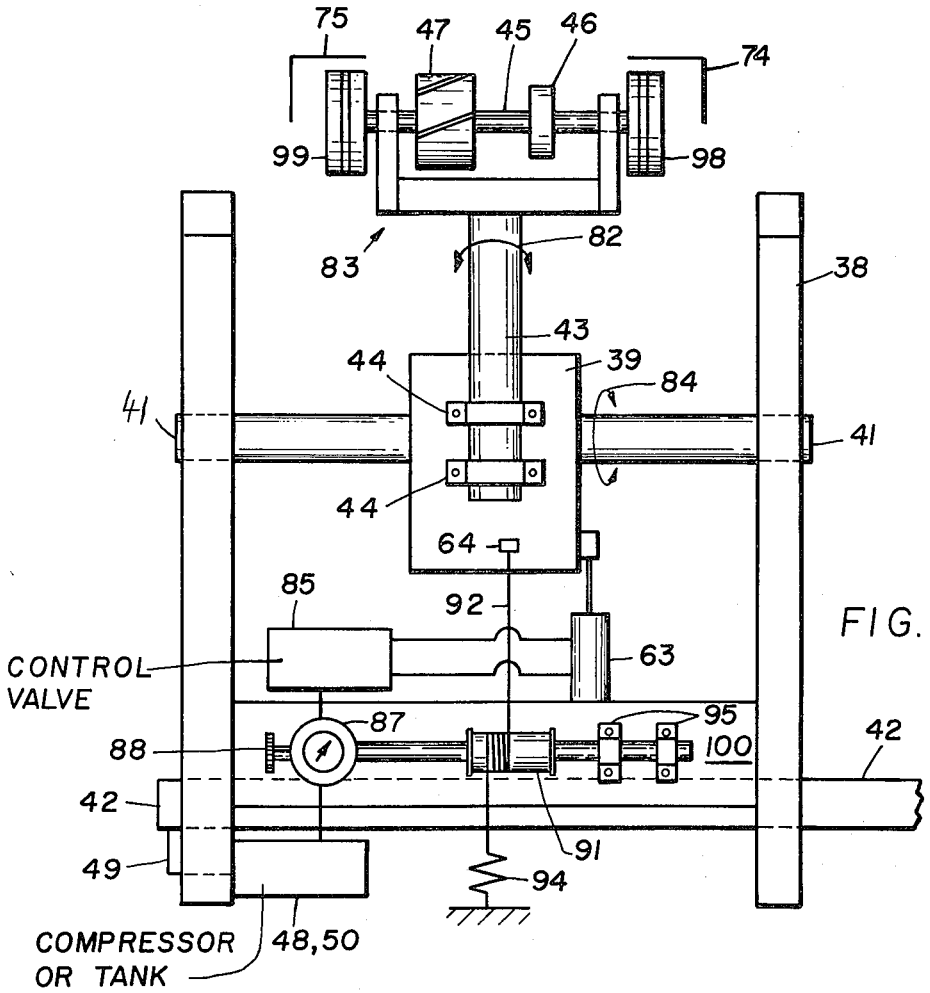
FIG. 5 is an elevational view of the tool support and tool control means.
Figure 6:
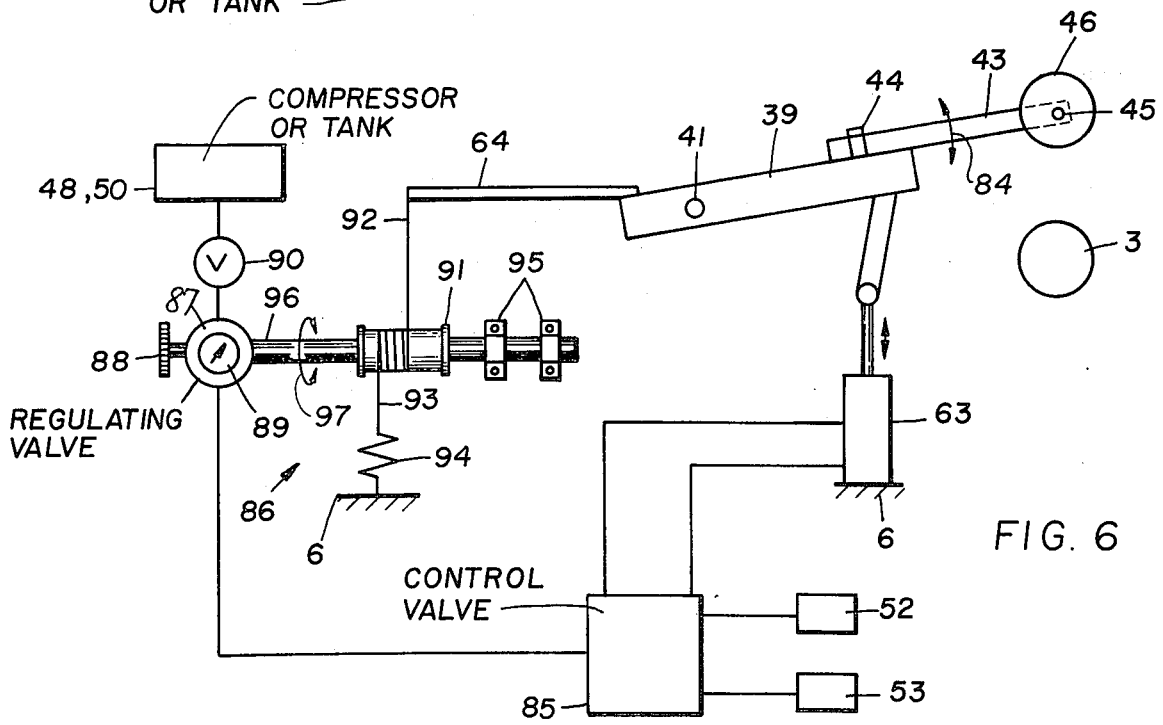
FIG. 6 illustrates the control mechanism for the tool position adjustment.

FIG. 5 is a simplified but somewhat enlarged view in side elevation similar to that of FIG. 4 and showing in more detail the tool support and tool pressure control means. Again, the same reference numerals are employed for the same elements. Thus, the cantilever arm 43 secured to the platform 39 by bearings 44 is tiltable in the direction of the arrow 82 whereby the tool head 83 secured to the free end of the cantilever arm 43 may yield in response to irregularites on the surface of the tree trunk 3. Further, as described, the platform 39 is tiltable about the axis of shaft 41 as indicated by the arrow 84 also shown in FIG. 6. This tilting about the shaft 41 is accomplished by the piston cylinder arrangement 63 which is operatively connected to a control valve 85 which is also responsive to the trip dog switches 52 and 53 to bring the tool head 83 into and out of its operational position in response to the passage of a tree trunk. The switches or acutators 52, 53 are preferably pneumatic actuators. However, electrical relay actuators could be employed instead.

A feedback control mechanism 86 is also connected to the control valve 85 through a regualting valve 87. The vale 87 may be combined with a manual control 88 and with a pressure indicator 89. The regulating valve is connected to the compressor or pressure tank, preferably through a pressure reduction valve 90.

The feedback control mechanism 86 has the purpose to control the instantaneous position of the platform 39 with the cantilever arm 43 through the piston cylinder arrangement 63 in response to irregularities on the surface of the tree trunk. Thus, an arm 64 secured to the platform 39 follows the movements of the platform 39 about the pivot axis 41 and this following movement is supplied to a pulley 91 by a cable 92 which is wound about the pulley 91 and secured with its other end 93 to the frame structure 6 through a spring 94. The spring keeps the cable 92, 93 tight regardless of the instantanious angular position of the platform 39. The pulley 91 is rotatably held by bearings 95 and a shaft 96 transmits the rotation of the pulley 91 to the regulating valve 87. Thus, depending on the direction of movement as indicated by the arrow 97 the regulating valve will be correspondingly controlled. The regulating valve in turn controls the pressure supplied to the control valve 85 and thus the angular position of the platform 39 and its cantilever arm 43. The tension of the spring 94 could be adjusted by slightly changing the length of the cable 92.

Referring again to FIG. 5, it should be noted that in this figure the power transmission elements have been omitted for simplicity's sake except that the pulleys 98 and 99 which drive the tool rotor shaft 45 are shown supported by the tool head 83. The control means, including the feedback mechanism 86, control valves, pressure indicating means and the like are preferably arranged on a control panel 100 secured to the bridge structure 38 by conventional means.

In operation, the main drive shaft 42 may be continuously operating so that all the wheels 19, 20 driven by the main drive roller 14 and all the other power transmission means, especially for driving the tools 46, 47 will be rotating as long as the operator on the tractor does not disengage a clutch or the like on the tractor and not shown in the present illustration. The alternative, a clutch is interposed in a conventional manner between the main drive shaft 42 and the power transmission means which derive the power from the shaft 42. Such a clutch could, for example, also be operated by switches similar to switches 52, 53 or by the operator from the tractor.

In any event, the operator merely deposits by means of the crane 4 a tree trunk 3 onto the rotating wheels 19, 20 whereby the tree trunk is propelled in the direction of the arrow 51 and simultaneously rotated toward the first switch 52 which brings the tool head 83 into the operational position. As the tree trunk continuous its advance it is being peeled as described and when the end of the tree trunk passes the second switch 53 the tool head 83 will be brought out of its operational position while the tools may keep rotating, if desired. Similarly, the wheels 19, 20 keep rotating to discharge the tree entirely at the rear end of the peeler 1 whereby the peeled log 5 slides off the guide 54.

Due to the above described adjustability of the position of the tool head 83 it is possible to handle tree trunks having a wide range of diameters. Another advantage of the invention is seen in that the positioning of the wheels 19, 20 at different levels securely cradles the tree trunks in the desired position thereby obviating any danger that the tree trunk might roll off from one or the other side. To this end it is desirable that the row 17 of wheels is located at a somewhat higher level because this row 17 is opposite the tool means. In the operational position the tool means would also tend to keep the tree trunk in the passage 56 and any force component tending to roll the tree trunk over the wheels 19 in row 17 is compensated by the slightly higher position of these wheels 19.

It has been found that the bark removal by means of the present apparatus can be accomplished at a cost which corresponds to about 10% of the cost required prior to the invention for the same amount of work.

A still further advantage of the invention is seen in that the speed control of the feed advance in the longitudinal direction is easily accomplished by the angular position of the wheels as described whereby the diameters of the tree trunks may be taken into account to adjust the feed advance speed to the tree trunk diameter.

Instead of the illustrated pneumatic control means it will be appreciated that other control means, such as electric or hydraulic control means, may also be employed and that the number of wheels in each row may be varied. In addition, it may be desirable to longitudinally displace one row of wheels relative to the other so that the wheels in one row register with the spaces in the other row and vice versa rather than providing for an alignment of the wheels in the same plane as illustrated.

Although the invention has been described with reference to specific example embodiments, it will be appreciated, that it is intended to cover all modifications and equivalents within the scope of the appended claims.

What is claimed is:

1. A tree bark removing apparatus comprising a frame structure having a longitudinal axis and spaced side frame members, as well as cross frame members, tree drive means rotatably supported on said frame structure, first and second rows of wheel means, each row including a number of wheels, support means for individually supporting each wheel on said frame structure in a substantially vertical plane, said rows of wheels extending in parallel to each other and spaced from each other to form a tree trunk passage, said drive means rotating said wheels, tool support means secured to said frame structure, tool means rotatably supported by said tool support means above said trunk passage for contacting a tree travelling through said passage, tool drive means operatively connected to said tool means, wherein said tree drive means comprise a longitudinal drive roller rotatably supported between said side frame members, said wheel support means supporting said wheels to contact said longitudinal drive roller, and power drive transmission means operatively connected to said longitudinal drive roller.

2. The apparatus according to claim 1, wherein said wheel support means comprise a tilting arm for each wheel, a carrier for each tilting arm supported on said frame structure and means journaling each tilting arm to its carrier, whereby each wheel may yield in a vertical plane in response to irregularities on the tree trunk.

3. The apparatus according to claim 2, further comprising pivot means securing each carrier to said frame structure whereby the respective wheel is adjustable in its angular position relative to said longitudinal axis of the frame structure and thus relative to said tree trunk passage.

4. The apparatus according to claim 3, further comprising operating means interconnecting said carriers for tilting said wheels in unison, whereby the wheels of a row preferably extend in parallel to each other.

5. The apparatus according to claim 3, wherein said angular position of each wheel relative to said longitudinal axis has an angle within a range of 0° to about 14°, said angle being included between the normal to said longitudinal axis and the plane extending vertically through the respective wheel and normal to the rotational axis of the wheel.

6. The apparatus according to claim 1, wherein said wheels are pneumatic wheels, and wherein the wheels of a row extend in parallel to each other and in register with the wheels of the respective other row of wheels.

7. The apparatus according to claim 1, wherein said tool support means comprise bridge mans on said frame structure, tool carrier means including tiltable cantilever means and rotatable shaft means supported by said cantilever means on said bridge means, said tool means being secured to said shaft means which shaft means are rotatable by said tool drive means.

8. The apparatus according to claim 7, further comprising pressure control means operatively connected to said tool carrier means for adjusting the pressure with which the tool means is applied to a tree trunk.

9. The apparatus according to claim 7, wherein said tool means comprise a cutting blade and bark shredding means arranged on said rotatable shaft so that the cutting blade forms a helical cut in a rotating and advancing tree trunk ahead of said shredding means as viewed in the direction of trunk advance.

10. The apparatus according to claim 7, wherein said tool drive means comprise power transmission means operatively interposed between said drive means and said tool drive means.

11. The apparatus according to claim 7, comprising a journal axis supporting said tool carrier means on said bridge means, whereby said tool carrier means are tiltable up and down and whereby said cantilever secured to said tool carrier means is tiltable up and down in the tool carrier means, wherein said cantilever means is adjustable in its effective position, and wherein the cantilever means is tiltable relative to said tool carrier means, whereby the rotatable shaft secured to said cantilever means is titlable relative to a tree trunk to respond to irregularities on the surface of such tree trunk.

12. The apparatus according to claim 11, further comprising a source of pressure, piston cylinder means interconnected between said tool carrier mans and said frame structure and responsive to said source of pressure, and feedback means responsive to the tilting of said tool carrier means and controlling the supply of pressure for adjusting said piston cylinder means and thus the pressure exerted by said tool means on a tree trunk, whereby said tool means may yield to irregularities in the surface of the tree trunk.

13. The apparatus according to claim 12, wherein said source of pressure is a compressor driven by said drive means.

14. The apparatus according to claim 12, wherein said tool drive means comprise pulleys rotatably supported on said journal axis of said tool carrier means and further pulleys on said rotatable shaft, as well as belt means interconnecting said pulleys and further pulleys, whereby said belt means are independent of any tilting of said tool carrier means and guide pulleys on said tool.

15.The apparatus according to claim 1, further comprising tree trunk position responsive switch means operatively connected to said tool carrier means for lowering the tool carrier means when a trunk enters said passage and for raising said tool carrier means when a trunk leaves said passage.

16. The apparatus according to claim 1, wherein one of said rows of wheels is supported on a level somewhat higher than said other row, and wherein said drive means comprise a roller located to contact both rows of wheels to drive the wheels by friction, said wheels rotating in the same directions relative to each other.

17. The apparatus according to claim 1, wherein at least a portion of said frame structure is part of a pressure conduit system.

18. The apparatus according to claim 1, further comprising trunk guide means secured to said frame structure at an exit end of said tree trunk passage whereby the debarked trunks are placed in an orderly fashion.

19. The apparatus according to claim 1, wherein said tree drive means and said tool drive means comprise a common power input means (12) for connection to a common source of power.

* * * * *

UNITED STATES PATENT OFFICE

CERTIFICATE OF CORRECTION

Patent No. 3, 987,825 Dated October 26, 1976

Inventor(s) Jean-Claude Vignolles

It is certified that error appears in the above-identified patent and that said Letters Patent are hereby corrected as shown below:

Column 8, line 55, change "mans" to --means--.

Column 9, line 12, change "in" to --with--.

9, line 21, change "mans" to --means--.

Signed and Sealed this

Fifteenth Day of February 1977

[SEAL]

*Attest:*

RUTH C. MASON
*Attesting Officer*

C. MARSHALL DANN
*Commissioner of Patents and Trademarks*